United States Patent [19]

Mueller

[11] 4,407,138

[45] Oct. 4, 1983

[54] HEAT PUMP SYSTEM DEFROST CONTROL SYSTEM WITH OVERRIDE

[75] Inventor: Dale A. Mueller, St. Paul, Minn.

[73] Assignee: Honeywell Inc., Minneapolis, Minn.

[21] Appl. No.: 278,944

[22] Filed: Jun. 30, 1981

[51] Int. Cl.[3] ..... F25D 21/02; F25D 21/06

[52] U.S. Cl. ..... 62/126; 62/140; 62/155

[58] Field of Search ..... 62/155, 234, 140, 128, 62/125, 126, 127, 156, 154, 151, 160, 324.1, 231; 165/17

[56] References Cited

U.S. PATENT DOCUMENTS 3,312,081 4/1967 Berger et al. ..... 62/231

4,209,994 7/1980 Mueller et al. ..... 62/155

4,299,095 11/1981 Cassarino ..... 62/155

4,327,556 5/1982 Zampini et al. ..... 62/155

*Primary Examiner*—Albert J. Makay

*Assistant Examiner*—Harry Tanner

*Attorney, Agent, or Firm*—Roger W. Jensen

[57] ABSTRACT

A defrost control system for a reverse cycle refrigeration system wherein the outdoor coil is defrosted as a function of the operation of a demand type control for initiating the defrost mode of operation. The control system further includes a means for monitoring the frequency of defrost cycles. If too frequent defrosting is detected then the demand system is overriden and subsequent defrosting occurs only after the heat pump has been operating in the normal heating mode of operation for a predetermined length of time.

20 Claims, 5 Drawing Figures

HEAT PUMP SYSTEM DEFROST CONTROL SYSTEM WITH OVERRIDE

BACKGROUND OF THE INVENTION

A long-standing problem associated with the use of heat pumps in most climatic regions of the world is that frequently the outdoor coil will, during the heating mode of operating, have ice accumulate thereon. As the ice thickness increases, the overall efficiency of the heat pump system decreases significantly, and a substantial amount of energy may be wasted. Accordingly, many arrangements have been proposed heretofore for detecting the ice and for taking corrective action for removing the ice from the outdoor coil. Examples of prior art systems include the following U.S. Pat. Nos.: 3,170,304; 3,170,305; 3,400,553 and 4,209,994.

It has been recognized that, for a given set of criteria, there is an optimum point (of ice built up) at which to command a defrost mode of operation of the heat pump system. If defrost is commanded too soon or too late, energy will be wasted, i.e., total system efficiency will suffer.

The present invention is a defrost control system which addresses the problem which is sometimes encountered wherein a demand type defrost control system will, for various reasons, demand too frequently a defrost mode of operation. Demand type defrost control systems are old in the art. A first type compares the outdoor coil inlet air temperature with the outlet air temperature thereof and whenever the differential of these temperatures exceeds a certain preselected value, then defrost is commanded. Another prior art demand system is to compare the outdoor air temperature with the outdoor coil temperature and upon a preselected differential between such temperatures the defrost mode of operation is commanded. Also, another demand system is to compare the air pressure associated with the inlet and outlet of the outdoor coil, i.e., the air passing through the coil and, whenever the differential pressure between such points exceeds a certain preselected value, the defrost mode of operation is commanded. As indicated, there can be problems associated with such demand type systems which will cause unrequired defrost operations which in turn results in a plummeting of the overall system efficiency. With a differential temperature control system, for example, an evaporator fan failure will cause a large differential of temperature and thereby command numerous defrosts each hour of time rather than only several per day. A similar situation occurs for both the differential temperature and the differential pressure methods if the evaporator clogs up because of leaves, dirt, a snowdrift, or the inability of the heat pump to defrost because of other factors.

SUMMARY OF THE INVENTION

The present invention is an outdoor coil defrost control system which comprises in part a demand type control for initiating the defrost mode of operation, the control system further comprising a means for monitoring the frequency of defrost and means for determining whether defrosting is occurring too frequently. If too frequent defrosting is detected, then the control system functions to prevent the initiation of a defrost mode of operation and to continue such overrides by allowing the normal heating mode of operation for a predetermined length of time and thence be effective to place the heat pump system into an outdoor coil defrost mode of operation. My invention is further characterized by the defrost control system comprising a false warning apparatus with such apparatus being actuated when said means preventing defrost or override means is rendered effective. In addition, the defrost control system may comprise a system fault reset means associated with the fault warning apparatus, the defrost control system continuing to command (after the initial fault warning) defrost modes of operation as a function of a predetermined length of time until the system fault reset means has been actuated.

Thus the present invention enjoys the advantages of a demand type control for the initiation of defrost mode of operation, but with an override protection in the event of a malfunction of such demand control that would cause excessive defrosting, the protecton means providing a fault warning apparatus and further providing a fixed time type of defrost mode of operation until the system fault reset means has been actuated.

DESCRIPTION OF THE PREFERRED EMBODIMENT

Figure 1:
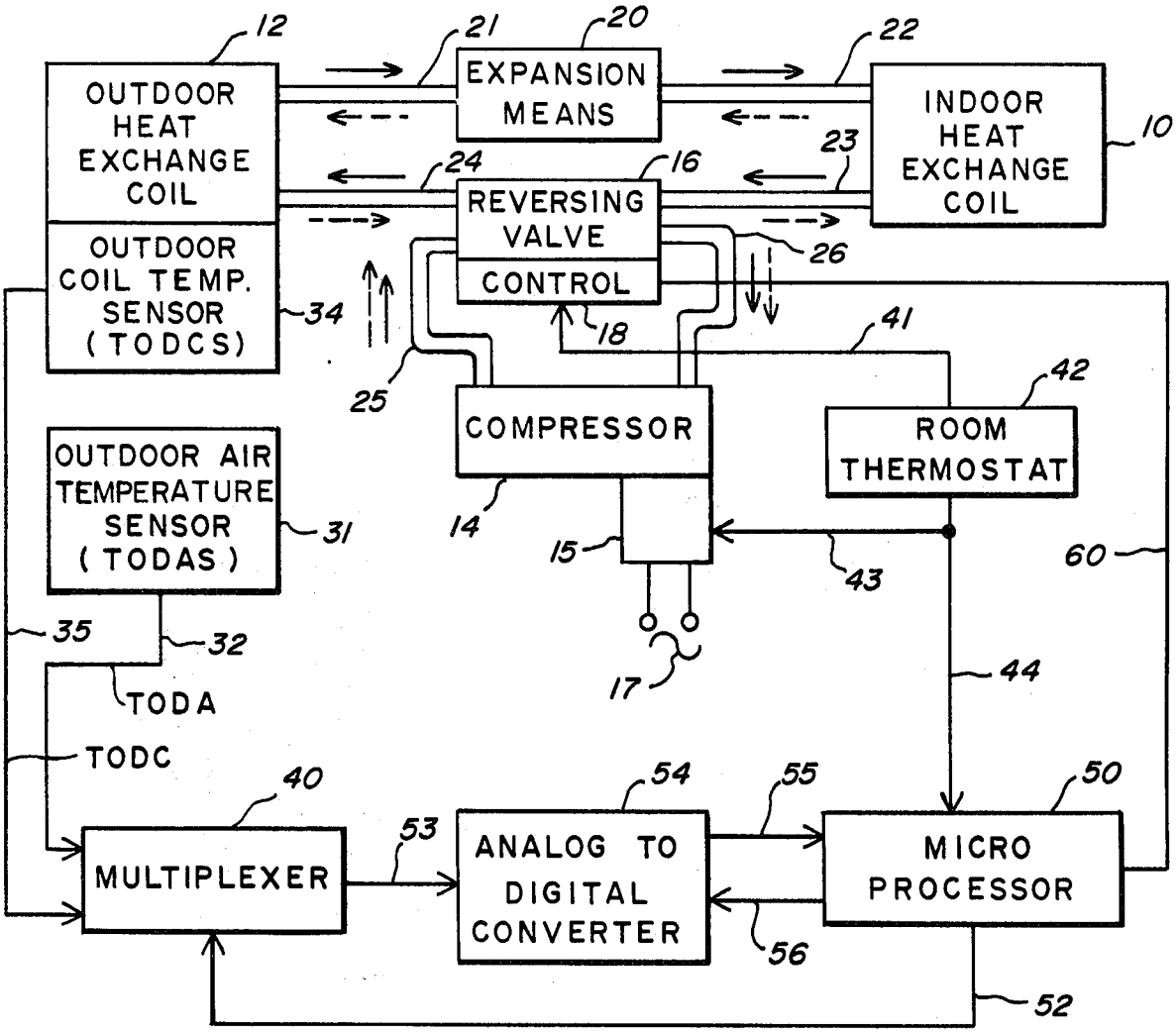
FIG. 1 is a block diagram of a reverse cycle refrigeration system utilizing the present invention.

Referring to FIG. 1, a reverse cycle refrigeration system comprises an indoor heat exchange coil 10, an outdoor heat exchange coil 12, a refrigerant compression means or compressor 14 and refrigerant conduit means interconnecting the coils and the compressor, the refrigerant conduit means including a reversing valve 16 having a control 18, an expansion means 20, and appropriate piping 21–26. The system as thus far described is old in the art and is exemplified by the above identified patents; e.g., U.S. Pat. No. 3,170,304. Briefly, during the indoor heating mode, i.e, when the reverse cycle system is operating to heat the inside of a building, compressor 14 will discharge relatively hot gaseous refrigerant through pipe 25, reversing valve 16 and pipe 23 to the indoor heat exchange coil 10. During the cooling or defrost mode, the reversing valve 16 is operated so that the hot gaseous refrigerant from the compressor is routed via pipe 25, reversing valve 16 and pipe 24 to the outdoor heat exchange coil 12.

A defrost control system of the demand type is also depicted comprising an outdoor air temperature sensing means 31 which will hereinafter sometimes be referred to as "TODAS". Outdoor air temperature sensing means 31 has an output 32 on which is available an output signal "TODA" indicative of the outdoor air temperature. Output 32 is one of two inputs to a multiplexer 40 to be described in more detail below. The defrost control system further comprises outdoor coil temperature sensing means which hereinafter may be referred to as "TODCS" identified in FIG. 1 by the reference numeral 34 having an output lead 35 on which is available an output signal "TODC" indicative of the temperature of the outdoor coil, lead 35 being connected to multiplexer 40 as the second input thereof.

Compressor 14 is controlled by a controller 15 adapted to be energized from a suitable supply of electric power 17 and to be controlled from a rest or "off" position to an operating or "on" condition as a function of either "heating" or "cooling" control signals applied to controller 15 from a suitable room thermostat 42 through interconnection means 43. The reversing valve 16 is also controlled via a connection 41 by the room thermostat 42 to be in the appropriate position for the commanded system mode of operation; i.e., heating or cooling. The output from the room thermostat 42 is also applied through a connection 44 as a first input to a microprocessor 50.

A connection 52 linking the microprocessor 50 and the multiplexer 40 enables the microprocessor to control the multiplexer in a manner well known to those skilled in the art so that appearing at the output 53 of the multiplexer will be either a TODA signal indicative of outdoor air temperature as sensed by TODAS 31 or an outdoor coil temperature TODC as sensed by TODCS 34. The output 53 of the multiplexer 40 is applied as an input to an analog-to-digital converter 54 which has an output 55 applied to the microprocessor 50 and which receives through connection 56 an input from the microprocessor 50. Analog-to-digital converter 54 functions to convert the analog temperature signals appearing at input 53 thereof into a digital form for utilization by the microprocessor 50.

The microprocessor 50 has an output connection 60 which is applied to control 18 of reversing valve 16, which in turn controls the mode of operation of the reverse cycle refrigeration system, i.e., either heating or cooling, it being understood that the cooling mode will cause the melting and dispersal of any frost on the outdoor coil which had accumulated during the prior heating mode of operation.

A suitable microprocessor that may be used as a component in the system comprising the present invention is the Intel Corporation Model 8049. Further, an appropriate analog-to-digital converter for use as item 54 is Texas Instruments Inc. Model TL505C (see T.I. Bulletin DL-5 12580); and an appropriate multiplexer is the Motorola Inc. Model MC14051BP. Further, Honeywall Inc., platinum film resistance type temperature sensors Models C800-A and C800-B may be used for TODAS 31 and TODCS 34 respectively; and Honeywell Inc. Model T872 thermostat may be used for room thermostat 42, the Model T872 being a bimetal operated mercury switch for heating-cooling and including switch means for controlling a plurality of auxiliary heating means. Further, an appropriate heat pump; i.e., components 10, 12, 14, 15, 16, is the Westinghouse Company HI-RE-LI unit comprising outdoor unit Model No. HL036COW and indoor unit AG012HOK.

It will be understood by those skilled in the art that the functional interconnections depicted in FIG. 1 are representative of one or more electrical wires or pipes, as the case may be, as indicated by the specific equipment used. It will also be understood that the room thermostat means 42 may be referred to as a means which is operatively associated with the compressor 14 and adapted to have an output indicative of the operation of the compressor because operation of the thermostat causes operation of compressor 14 from an "off" to an "on" or operating condition; connection 44 from thermostat 42 to microprocessor 50 thus constitutes an input indicative of compressor operation.

Figure 2A:
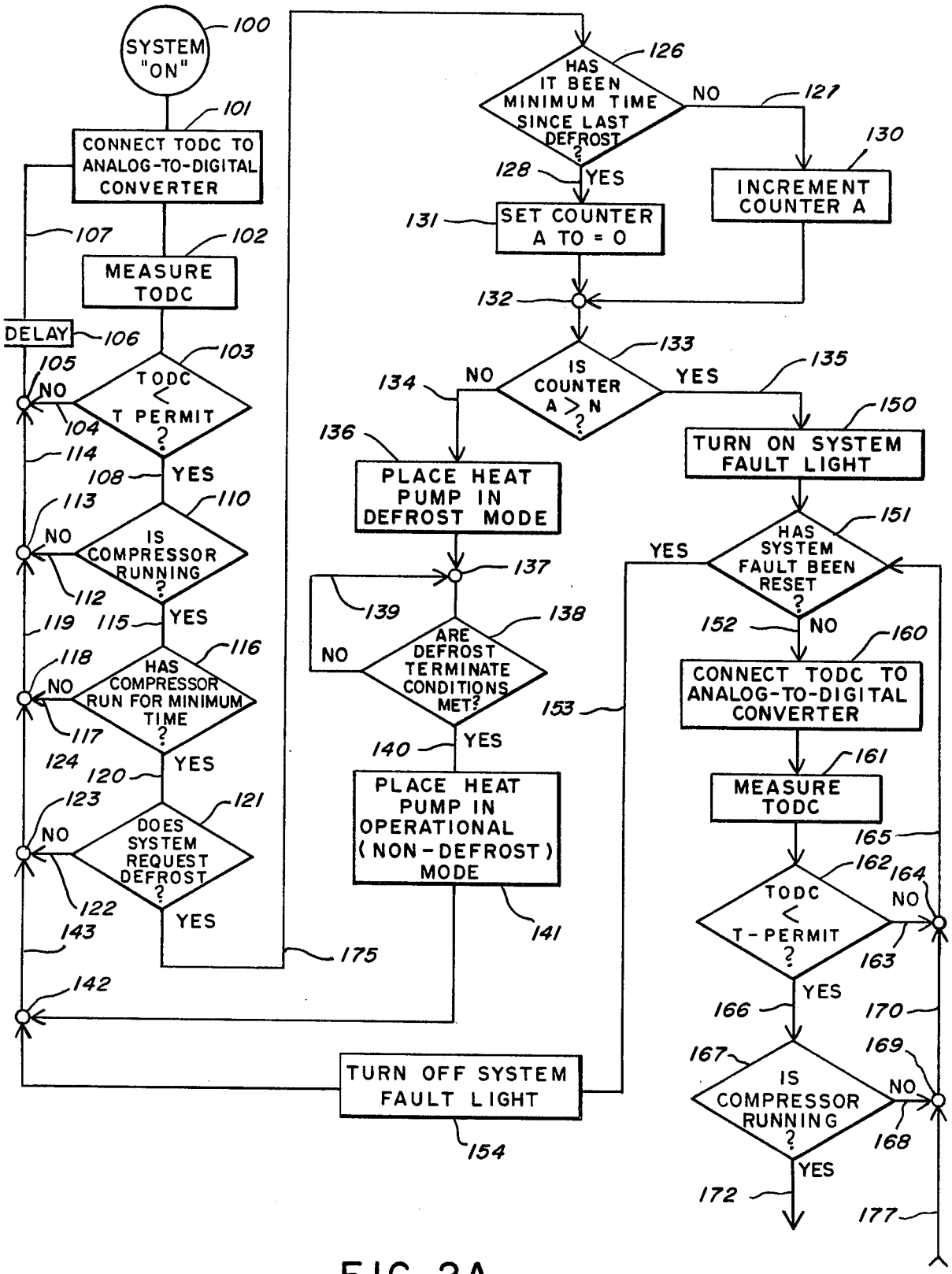
FIGS. 2A and 2B comprise a flow diagram for the control of the microprocessor depicted as one of the elements of the system of FIG. 1.
Figure 2B:
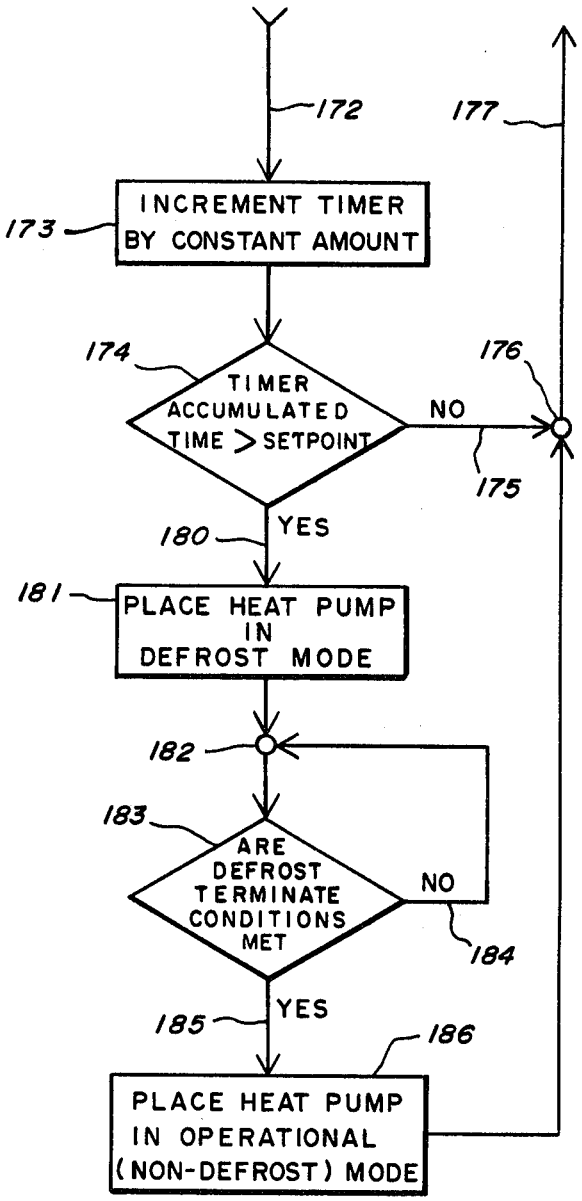

FIGS. 2A and 2B, the flow chart for the apparatus of FIG. 1, includes an entry point 100 "SYSTEM ON" the flow from which is to instruction block 101 "CONNECT TODC TO ANALOG-TO-DIGITAL CONVERTER" which flows to instruction block 102 "MEASURE TODC" the flow from which is to a logic instruction block 103 "TODC LESS THAN T PERMIT" having a 37 no" response 104 which flows to a junction 105 and thence to a delay means 106 and thence through 107 back to 101 "CONNECT TODC TO ANALOG-DIGITAL-CONVERTER". Logic instruction 103 "TODC LESS THAN T PERMIT" also includes a "yes" response 108 which flows to a logic instruction block 110 "IS COMPRESSOR RUNNING?" having a "no" response 112 which flows through a junction 113 and 114 to junction 105 and a "yes" response 115 which flows to a logic instruction block 116 "HAS COMPRESSOR RUN FOR MINIMUM TIME?" having a "no" response 117 which flows via junction 118 and means 119 through junction 113. Logic instruction block 116 "HAS COMPRESSOR RUN FOR MINIMUM TIME?" also has a "yes" response 120 which flows to a logic instruction block 121 "DOES SYSTEM REQUEST DEFROST?" having a "no" response flowing via a junction 123 and a means 124 to junction 118 and a "yes" response 125 flowing to a logic instruction block 126 "HAS IT BEEN MINIMUM TIME SINCE LAST DEFROST?" having a "no" response 127 which flows to an instruction block 130 "INCREMENT COUNTER A" and a "yes" response 128 which flows to an instruction block 131 "SET COUNTER A TO=0". The flow from both instruction blocks 130 "INCREMENT COUNTER A" and 131 "SET COUNTER A TO O" is to a junction 132 and thence to a logic instruction block 133 "IS COUNTER A GREATER THAN N?" having a "no" response 134 which flows to an instruction block 136 "PLACE HEAT PUMP IN DEFROST MODE" and thence to a junction via a junction 137 to a logic instruction block 138 "ARE DEFROST TERMINATE CONDITIONS MET?" having a "no" response 139 flowing to junction 137 and a "yes" response 140 flowing to an instruction block 141 "PLACE HEAT PUMP IN OPERATIONAL (NON-DEFROST-)MODE" the flow from which is to junction 142 and thence to a means 143 to junction 123.

Logic instruction block 133 has a "yes" response 134 flowing to an instruction block 150 "TURN ON SYSTEM FAULT LIGHT" the flow from which is to a logic instruction block 151 "HAS SYSTEM FAULT BEEN RESET?" having a "yes" response 153 flowing to an instruction block 154 "TURN OFF SYSTEM FAULT LIGHT" and thence to junction 142. Logic instruction block 151 also has a "no" response 152 flowing to an instruction block 160 "CONNECT TODC TO ANALOG-TO-DIGITAL CONVERTER" the flow from which is to an instruction block 161 "MEASURE TODC" the flow from which is to a logic instruction block 162 "TODC LESS THAN T PERMIT?" having a "no" response 163 flowing via a junction 164 and a connection means 165 back to logic instruction block 151. Logic instruction block 162 also has a "yes" response 166 flowing to a logic instruction block 167 "IS COMPRESSOR RUNNING?" having a "no" response 168 which flows via a junction 169 and connection means 170 to junction 164. Logic instruction block 167 also has a "yes" response 172 flowing to an instruction block 173 "INCREMENT TIMER BY CONSTANT AMOUNT" the flow from which is to a logic instruction block 174 "TIMER ACCUMULATED TIME GREATER THAN SETPOINT?" have a "no" response 175 flowing via a junction 176 and a connection means 177 to a junction 169, block 174 also having a "yes" response 180 which flows via an instruction block 181 "PLACE HEAT PUMP IN DEFROST MODE" the flow from which is to a junction 182 and thence to a logic instruction block 183 "ARE DEFROST TERMINATE CONDITIONS MET?" having a "no" response 184 flowing back to junction 182 and a "yes" response 185 flowing to an instruction block 186 "PLACE HEAT PUMP IN OPERATIONAL (NON-DEFROST) MODE" the flow from which is to junction 176.

DESCRIPTION OF OPERATION OF FIGS. 1 AND 2

Figure 2B:
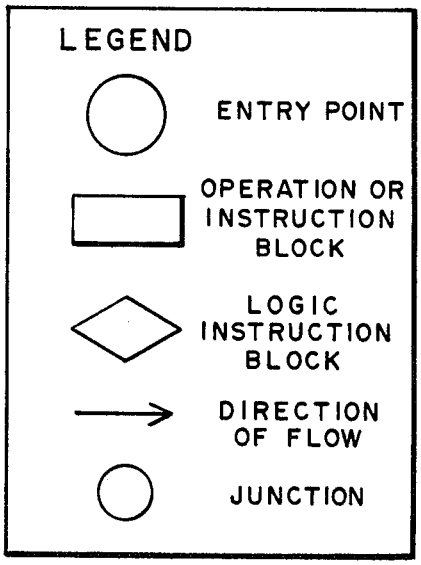

In the operation of the apparatus shown in FIGS. 1 and 2, the outdoor coil temperature TODC and the outdoor air temperature TODA as found on leads 35 and 32 respectively, are applied selectively by the multiplexer 40 to the analog-to-digital converter 54 and thence via 55 to the microprocessor 50, the microprocessor 50 also receiving a signal from the room thermostat 42 via lead 44 as a signal indicative of the operation of the heat pump control system. The microprocessor is appropriately programmed to initiate a defrost mode of operation of the heat pump system whenever an initiate signal is developed by the demand system depicted in FIG. 1, i.e., the sensors 31 and 34 and their respective signals, i.e., TODA on lead 32 and TODC on lead 35. Upon the difference between TODA and TODC reaching a preselected amount then defrost will be initiated, the microprocessor commanding via lead 60 a reversal of the reversing valve 16 so that hot refrigerant previously being directed to the indoor heat exchange coil 10 is reversed and redirected so as to flow through the outdoor heat exchange coil 12 so as to melt off accumulated frost and ice.

The means for detecting excessive defrosting is depicted in FIG. 2. Blocks 101, 102 and 103 are representative of the measurement of TODC at a particular point of time and the comparison of TODC with T PERMIT. If TODC is greater than T PERMIT, then no defrost is initiated. However, if TODC is less than T PERMIT, then the block 103 has a "yes" response which flows sequentially through logic instruction blocks 110, 116, 121 to 126. If the compressor is running and if the compressor has run for a minimum length of time, e.g., ten minutes, and if there is a demand for defrost as determined by the above discussed differential between TODA and TODC, this determination being represented by logic instruction block 121, then logic instruction block 126 is representative of the making of a determination as to whether or not a minimum time has elapsed since the previous defrost, e.g., more than thirty minutes. If less than the minimum time has elapsed then this is indicative of too frequent defrost and accordingly the "yes" response at 127 will cause the counter A to be advanced one increment as at 130. On the other hand if at least the minimum time has elapsed since the previous defrost then the "no" response at 128 will result in the counter A to be set to zero. Logic instruction 133 determines whether the count on counter A is greater than a preselected constant N, a representative value of N being 3. In other words, if the loop which includes instruction block 130 has been incremented four times so that the count on counter A is greater than 3, then when the flowing reaches logic instruction block 133 the "yes" response thereof at 135 functions immediately via instruction block 150 to turn on the system fault light. On the other hand, if the flow from 133 is the "no" response at 134, then the heat pump system is placed in the defrost mode of operation as at 136 and after the defrost terminate conditions are met as represented by logic instruction block 138, e.g., TODC rises up to a terminate temperature, then the heat pump system is placed in a normal or non-defrost mode of operation as represented by 141.

Continuing the case where the response from 133 is a "yes" as at 135 indicating that too much or too frequent defrosting has been occurring, it will be noted that the flow from 150 is to the logic instruction block 151 which asks the question as to whether or not the system fault has been reset: this would be done by the person or means for detecting and correcting the fault; if the fault has not been reset, then the system goes into a fixed time interval between defrost mode of operation represented by blocks 160, 161, 162, 167, 173 and 174. The function of blocks 160–174 is to command a defrost if the basic demand criteria represented by blocks 162 and 167 give yes responses following which a timer means is incremented as at 173, the accumulated count on the timer being evaluated by logic instruction block 174 to determine whether or not the heat pump has operated for a preselected time before defrost, a representative value or time duration being ninety minutes. Assuming that the system has not been operating in the heating mode for ninety minutes, then the "no" response at 175 will flow back to 151 to keep the heat pump system operating in the heating mode until the response from 174 is a "yes" response at 180 which then results in the heat pump system being placed in the defrost mode of operation through the function of instruction block 181. Thereafter, the system continues in the defrost mode of operation until the response from logic instruction block 183 is a "yes" response and flows via 185 to 186 so as to place the heat pump back to the normal operational or non-defrost mode of operation. However, if the person or means doing the repair or correction has not reset the fault light or means, the system will continue to operate in the loop flowing from "no" response 152 of logic instruction block 151 through blocks 160, 161—to blocks 183 and 186, i.e., will continue operating in the fixed time type of control until the system fault has been reset at which time there will be a "yes" response from 151 as at 153 and the system is then shifted back to the demand control system described above.

DESCRIPTION OF OPERATION OF FIGS. 1A AND 1B

Figure 1A:
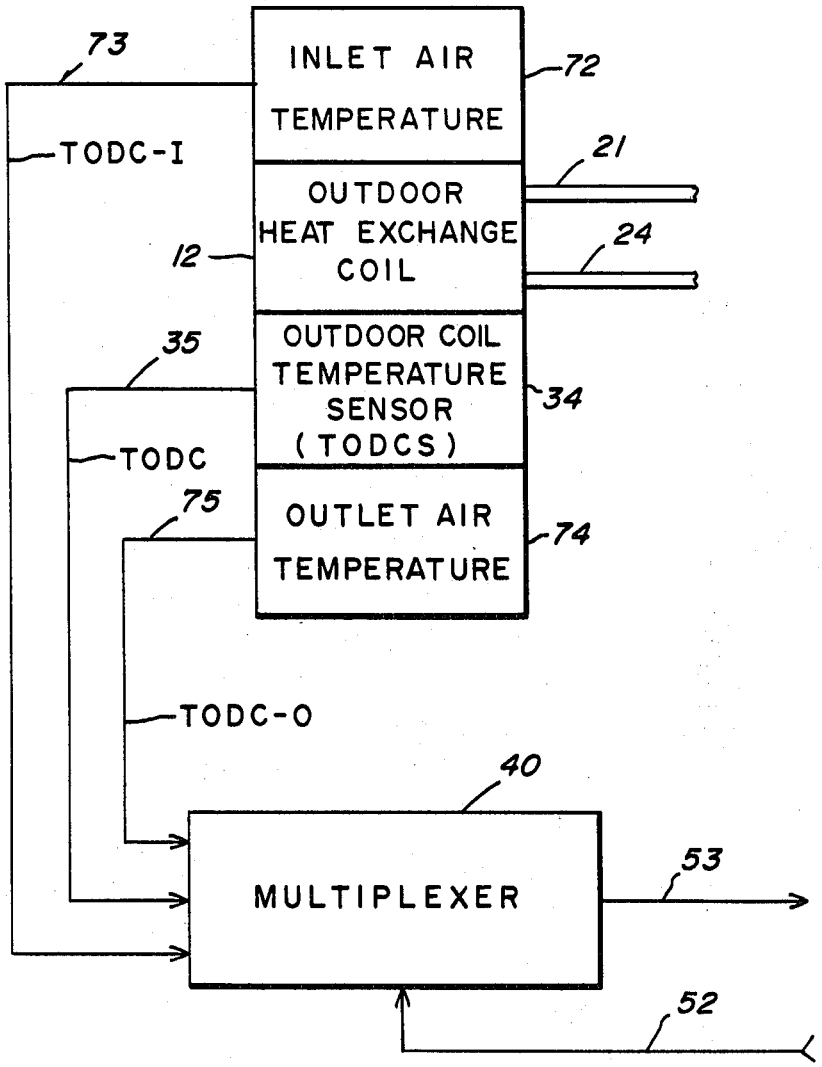
FIG. 1A is a block diagram of a modification of the system depicted in FIG. 1.
Figure 1B:
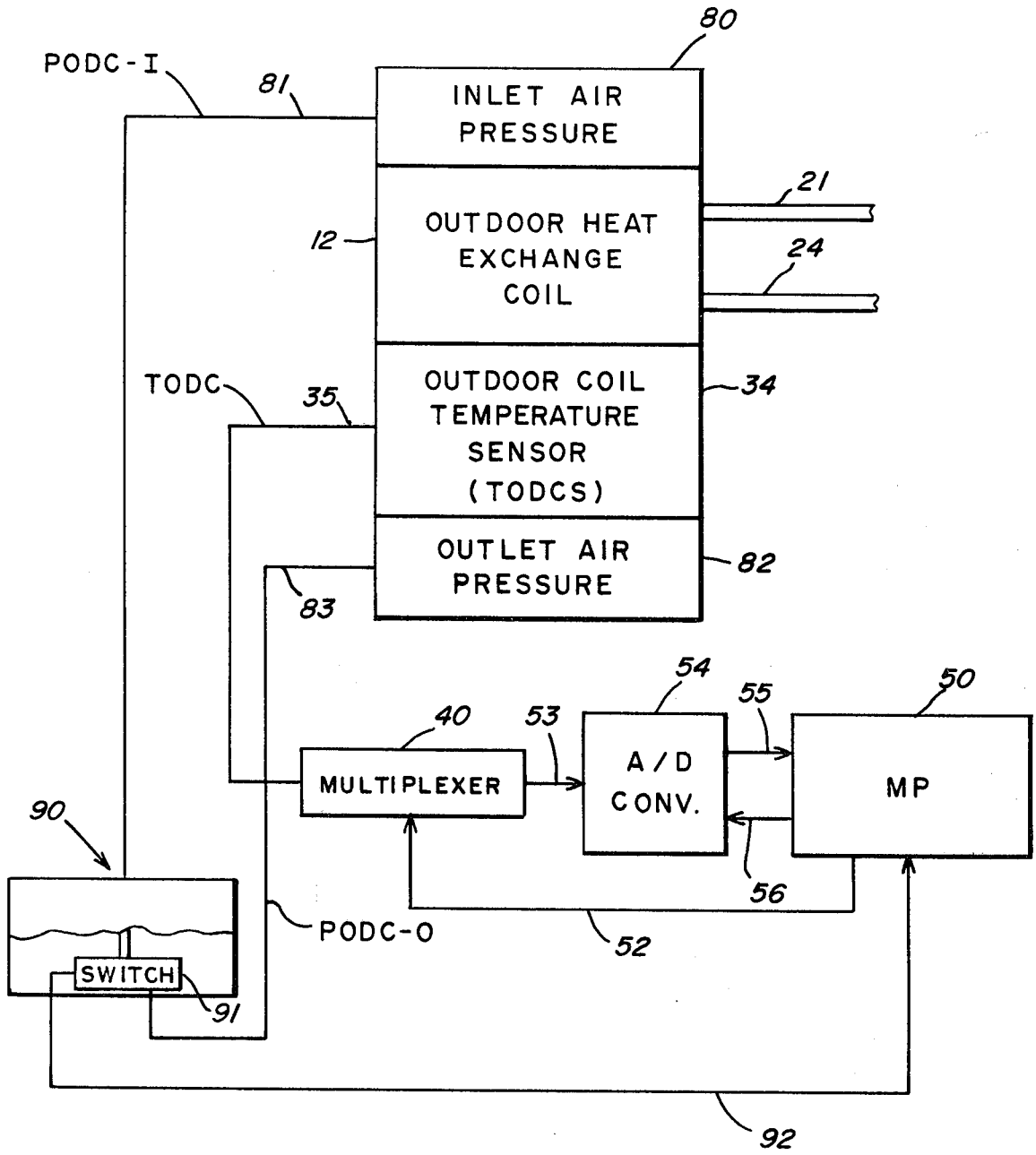
FIG. 1B is a block diagram showing another modification of the apparatus shown in FIG. 1.

FIGS. 1A and 1B show alternate arrangements for demand type control of the defrost mode of operation. Referring to FIG. 1A, the outdoor heat exchange coil 12 again has associated therewith an outdoor coil temperature sensor TODCS 34. In addition, an inlet air temperature sensor 72 and an outlet air temperature sensor 74 are provided having respectively outputs at 73 and 75 TODC-I and TODC-O. Thus, three temperature signals: TODC, TODC-I, and TODC-I are applied via leads 35, 73 and 75 respectively to multiplexer 40. In operation, the logic instruction block 121 "DOES SYSTEM REQUEST DEFROST?" is representative of the measurement of differential between the inlet air temperature TODC-I and the outlet air temperature TODC-O and, whenever such differential exceeds a predetermined value, this would initiate defrost thus providing a "yes" response at 125.

Referring to FIG. 1B, a demand differential pressure control system is depicted, i.e., the apparatus therefore, comprising, with respect to the outdoor heat exchange coil 12, an inlet air pressure sensor 80 having an output 81 with a signal thereon indicative of such inlet air pressure hereinafter referred to as PODC-I. Further, an outlet air pressure detector means 82 has an output 83 on which is the signal PODC-O. The signals PODC-I and PODC-O are summed by a mechanism such as a diaphragm or bellows 90. Again the outdoor coil temperature sensor TODCS 34 has an output 35 connected to the multiplexer 40 so that at the output 53 will be TODC. Bellows 90 comprises a switch means 91 adapted to be actuated upon a preselected pressure differential between signals PODC-I and PODC-O. A connection means 92 connected between switch 91 and microprocessor 50 enables the latter, i.e., a "yes" response from logic instruction block 121 "DOES SYSTEM REQUIRE DEFROST?" when the preselected demand condition (PODC-I is greater than PODC-O+K) is reached.

Equipment that can be used in the embodiment for FIG. 1A would include for the inlet air temperature and outlet air temperature sensors 72 and 74, a Honeywell manufactured thermostat model No. CR70A. Also for the apparatus of FIG. 1B, the air pressure sensors 80 and 82 can be implemented by utilization of a product manufactured by the Robertshaw Company Model DS11.

While I have described a preferred embodiment of the invention, it will be understood that the invention is limited only by the scope of the following claims:

I claim:

1. An outdoor coil defrost control system (hereinafter "defrost control system") for a reverse cycle refrigeration system (hereinafter "system") for heating and cooling a building wherein said system comprises refrigerant compression means, an indoor coil, an outdoor coil, and refrigerant conduit means connecting said compression means and said coils, said defrost control system comprising:

outdoor air temperature sensing means (hereinafter "TODAS") having an output indicative of outdoor air temperature (hereinafter "TODA");

outdoor coil temperature sensing means (hereinafter "TODCS") having an output indicative of the temperature of said outdoor coil (hereinafter "TODC");

enclosure temperature sensing means (hereinafter "STAT") having an output indicative of a demand for heating or cooling of the enclosure;

means (hereinafter "COM") operatively associated with said compression means and adapted to have an output indicative of the operation of said compression means; and controller means including counting means and timing means and having operative connections to said TODA, TODC, STAT and COM so as to receive the outputs thereof, said controller being effective to place said system into an initial outdoor coil defrost mode of operation when all of the following four events have occurred:

(a) TODC is less than $T_{PERMIT}$, where $T_{PERMIT}$ is a preselected value, (b) COM output indicates operation of said compression means, (c) COM output indicates said compression means has operated for a preselected minimum time, and (d) TODC is less than TODA by a preselected constant;

thereafter said controller being effective to place said system into a non-defrost mode of operation when defrost terminate conditions have occurred; and thereafter said controller being effective to prevent the initiation of an outdoor coil defrost mode of operation whenever said controller has determined that said system has been placed into the defrost mode of operation more than a predetermined number of consecutive defrost intervals is less than a predetermined minimum time have occurred.

2. An outdoor coil defrost control system (hereinafter "defrost control system") for a reverse cycle refrigeration system (hereinafter "system") for heating and cooling a building wherein said system comprises refrigerant compression means, an indoor coil, an outdoor coil, and refrigerant conduit means connecting said compression means and said coils, said defrost control system comprising:

outdoor air temperature sensing means (hereinafter "TODAS") having an output indicative of outdoor air temperature (hereinafter "TODA");

outdoor coil temperature sensing means (hereinafter "TODCS") having an output indicative of the temperature of said outdoor coil (hereinafter "TODC");

enclosure temperature sensing means (hereinafter "STAT") having an output indicative of a demand for heating or cooling of the enclosure;

means (hereinafter "COM") operatively associated with said compression means and adapted to have an output indicative of the operation of said compression means; and controller means including timing means and counting means having operative connections to said TODA, TODC, STAT and COM so as to receive the outputs thereof, said controller being effective to place said system into an outdoor coil defrost mode of operation when TODA is greater than TODC by a predetermined value;

thereafter said controller being effective to place said system into a non-defrost mode of operation when defrost terminate conditions have occurred; and thereafter said controller being effective before each succeeding defrost mode of operation to prevent the initiation of an outdoor coil defrost mode of operation whenever said controller has determined that said system has been placed into the defrost mode of operation more than a predetermined number of consecutive defrost intervals in less than a predetermined minimum time have occurred.

3. Apparatus of claim 1 further characterized by said controller having additional means responsive to said prevention of defrost and operative to permit said system to operate in a heating mode of operation (if so commanded by said STAT) for a predetermined length of time and thence to be effective to place said system into an outdoor coil defrost mode of operation.

4. Apparatus of claim 3 further characterized by said defrost control system comprising a fault warning apparatus and said controller actuating said fault warning apparatus upon said prevention of defrost.

5. Apparatus of claim 4 further characterized by said defrost control system comprising a system fault reset means and to continue commanding defrost mode of operation as a function of said system operating in a heating mode for said predetermined length of time, until said system fault reset means has been actuated.

6. Apparatus of claim 2 further characterized by said controller having additional means responsive to said prevention of defrost and operative to permit said system to operate in a heating mode of operation (if so commanded by said STAT) for a predetermined length of time and thence to be effective to place said system into an outdoor coil defrost mode of operation.

7. Apparatus of claim 6 further characterized by said defrost control system comprising fault warning apparatus and said controller actuating said fault warning apparatus upon said prevention of defrost.

8. Apparatus of claim 7 further characterized by said defrost control system comprising a system fault reset means and to continue commanding defrost modes of operation as a function of said system operating in a heating mode for said predetermined length of time, until said system fault reset means has been actuated.

9. An outdoor coil defrost control system (hereinafter "defrost control system") for a reverse cycle refrigeration system (hereinafter "system") for heating and cooling a building wherein said system comprises refrigerant compression means, an indoor coil, an outdoor coil, and refrigerant conduit means connecting said compression means and said coils, said defrost control system comprising:

outdoor coil inlet air temperature sensing means having an output indicative of outdoor coil inlet air temperature (hereinafter "TODC-I");

outdoor coil outlet air temperature sensing means having an output indicative of the temperature of the outlet air of said outdoor coil (hereinafter "TODC-O");

enclosure temperature sensing means (hereinafter "STAT") having an output indicative of a demand for heating or cooling of the enclosure;

means (hereinafter "COM") operatively associated with said compression means and adapted to have an output indicative of the operation of said compression means; and controller means including timing means and counting means having operative connections to said TODC-I, TODC-O, STAT and COM so as to receive the outputs thereof, said controller being effective to place said system into an outdoor coil defrost mode of operation when TODC-I is greater than TODC-O by a predetermined amount;

thereafter said controller being effective to place said system into a non-defrost mode of operation when defrost terminate conditions have occurred; and thereafter said controller being effective before each succeeding defrost mode of operation to prevent the initiation of an outdoor coil defrost mode of operation whenever said controller has determined that said system has been placed into the defrost mode of operation more than a predetermined number of consecutive defrost intervals in less than a predetermined minimum time have occurred.

10. Apparatus of claim 9 further characterized by said controller having additional means responsive to said prevention of defrost and operative to permit said system to operate in a heating mode of operation (if so commanded by said STAT) for a predetermined length of time and thence to be effective to place said system into an outdoor coil defrost mode of operation.

11. Apparatus of claim 10 further characterized by said defrost control system comprising fault warning apparatus and said controller actuating said fault warning apparatus upon said prevention of defrost.

12. Apparatus of claim 11 further characterized by said defrost control system comprising a system fault reset means and to continue commanding defrost modes of operation as a function of said system operating in a heating mode for said predetermined length of time, until said system fault reset means has been actuated.

13. An outdoor coil defrost control system (hereinafter "defrost control system") for a reverse cycle refrigeration system (hereinafter "system") for heating and cooling a building wherein said system comprises refrigerant compression means, an indoor coil, an outdoor coil, and refrigerant conduit means connecting said compression means and said coils, said defrost control system comprising:

outdoor coil inlet air pressure sensing means having an output indicative of outdoor coil inlet air pressure (hereinafter "PODC-I");

outdoor coil outlet air pressure sensing means having an output indicative of the pressure of the outlet air of said outdoor coil (hereinafter "PODC-O");

enclosure temperature sensing means (hereinafter "STAT") having an output indicative of a demand for heating or cooling of the enclosure;

means (hereinafter "COM") operatively associated with said compression means and adapted to have an output indicative of the operation of said compression means; and controller means including timing means and counting means having operative connections to said PODC-I, PODC-O, STAT and COM so as to receive the outputs thereof, said conroller being effective to place said system into an outdoor coil defrost mode of operation when PODC-I is greater than PODC-O by a predetermined amount;

thereafter said controller being effective to place said system into a non-defrost mode of operation when defrost terminate conditions have occurred; and thereafter said controller being effective before each succeeding mode of operation to prevent the initiation of an outdoor coil defrost mode of operation whenever said controller has determined that said system has been placed into the defrost mode of operation more than a predetermined number of consecutive defrost intervals in less than a predetermined minimum time have occurred.

14. Apparatus of claim 13 further characterized by said controller having additional means responsive to said prevention of defrost and operative to permit said system to operate in a heating mode of operation (if so commanded by said STAT) for a predetermined length of time and thence to be effective to place said system into an outdoor coil defrost mode of operation.

15. Apparatus of claim 14 further characterized by said defrost control system comprising a fault warning apparatus and said controller actuating said fault warning apparatus upon said prevention of defrost.

16. Apparatus of claim 15 further characterized by said defrost control system comprising a system fault reset means and to continue commanding defrost modes of operation as a function of said system operating in a heating mode for said predetermined length of time, until said system fault reset means has been actuated.

17. An outdoor coil defrost control system (hereinafter "defrost control system") for a reverse cycle refrigeration system (hereinafter "system") for heating and cooling a building wherein said system comprises refrigerant compression means, an indoor coil, an outdoor coil, and refrigerant conduit means connecting said compression means and said coils, said defrost control system comprising controller means having a primary controlling mode of the demand type wherein a system defrost mode of operation is initiated upon a predetermined change in an operational parameter of said outdoor coil as compared to another operational parameter;

thereafter said controller being effective to place said system into a non-defrost mode of operation when defrost terminate conditions have occurred; and thereafter said controller being effective before each succeeding mode of operation to prevent the initiation of an outdoor coil defrost mode of operation whenever said controller has determined that said system has been placed into the defrost mode of operation more than a predetermined number of consecutive defrost intervals in less than a predetermined minimum time have occurred.

18. Apparatus of claim 17 further characterized by said controller having additional means responsive to said prevention of defrost and operative to permit said system to operate in a heating mode of operation for a predetermined length of time and thence to be effective to place said system into an outdoor coil defrost mode of operation.

19. Apparatus of claim 18 further characterized by said defrost control system comprising a fault warning apparatus and said controller actuating said fault warning apparatus upon said prevention of defrost.

20. Apparatus of claim 19 further characterized by said defrost control system comprising a system fault reset means and to continue commanding defrost modes of operation as a function of said system operating in a heating mode for said predetermined length of time, until said system fault reset means has been actuated.

* * * * *